US010464274B2

(12) United States Patent
Martin et al.

(10) Patent No.: US 10,464,274 B2
(45) Date of Patent: Nov. 5, 2019

(54) PRESS WITH DROP AWAY CONNECTING ARM AND STROKE ADJUSTMENT AND COUNTER WEIGHT DRIVE

(71) Applicants: James Martin, Beaverton, MI (US); Doug Harvey, Midland, MI (US); James Robbins, Sanford, MI (US); Kevin John Daley, British Columbia (GB)

(72) Inventors: James Martin, Beaverton, MI (US); Doug Harvey, Midland, MI (US); James Robbins, Sanford, MI (US); Kevin John Daley, British Columbia (GB)

(73) Assignee: Brown LLC

( * ) Notice: Subject to any disclaimer, the term of this patent is extended or adjusted under 35 U.S.C. 154(b) by 949 days.

(21) Appl. No.: 14/960,580

(22) Filed: Dec. 7, 2015

(65) Prior Publication Data

US 2016/0200061 A1 Jul. 14, 2016

Related U.S. Application Data

(60) Provisional application No. 62/103,112, filed on Jan. 14, 2015.

(51) Int. Cl.

| | |
|---|---|
| ***B30B 15/00*** | (2006.01) |
| ***B30B 15/02*** | (2006.01) |
| ***B26F 1/40*** | (2006.01) |

(52) U.S. Cl.

CPC ..... *B30B 15/0035* (2013.01); *B26F 1/405* (2013.01); *B30B 15/028* (2013.01); *B26F 2210/06* (2013.01)

(58) Field of Classification Search

CPC ..... B30B 15/0029; B30B 1/02; B30B 1/06; B30B 1/26; B30B 1/263; B30B 1/266;

(Continued)

(56) References Cited

U.S. PATENT DOCUMENTS 2,432,522 A * 12/1947 Howland-Shearman ..... B21D 28/16 74/38

4,664,645 A * 5/1987 Muck ..... B23D 47/12 299/39.3

(Continued)

FOREIGN PATENT DOCUMENTS

EP 1426584 A1 * 6/2004 ..... F02B 75/045

OTHER PUBLICATIONS

English translate (EP 1426584A1) retried date May 3, 2019.*

*Primary Examiner* — Christopher M Koehler
*Assistant Examiner* — Mohammed S. Alawadi
(74) *Attorney, Agent, or Firm* — John R. Benefiel

(57) ABSTRACT

A thermoforming trim press has one or more connecting arms for driving a movable platen, each arm having a pivotal connection between two adjacent sections of each connecting arm which is normally locked during normal press operation whereby the movable platen is able to move further back from a normal retracted position to increase the available clearance when changing or maintaining tools mounted on the movable platen. The pivoting ability of the connecting arm sections also simplifies adjusting the stroke of the press. A counterweight may be driven by the crank pins to match the press stroke adjustments and to thereby correspond the movement of the counterweight to the movement of the movable platen.

10 Claims, 7 Drawing Sheets

(58) Field of Classification Search
CPC ..... B30B 1/28; B30B 15/0035; B30B 15/028; B26F 1/405; B26F 2210/06; B23Q 5/02–20; A01F 15/0841; B21D 37/04; B21D 37/14
USPC ..... 100/282, 257; 72/242.5, 452.5
See application file for complete search history.

(56) References Cited

U.S. PATENT DOCUMENTS

| | | | | |
|---|---|---|---|---|
| 6,968,834 | B1 * | 11/2005 | Gibbs | F41B 5/1449 124/1 |
| 8,469,693 | B2 * | 6/2013 | Schad | B29C 45/32 425/190 |
| 2010/0278957 | A1 * | 11/2010 | Keeley | B30B 1/14 425/451.6 |
| 2011/0076079 | A1 * | 3/2011 | Robinson | B30B 15/028 400/76 |

* cited by examiner

PRESS WITH DROP AWAY CONNECTING ARM AND STROKE ADJUSTMENT AND COUNTER WEIGHT DRIVE

CROSS REFERENCE TO RELATED APPLICATIONS

This application claims the benefit of U.S. provisional patent application Ser. No. 62/103,112 filed on Jan. 14, 2015; and U.S. provisional patent application Ser. No. 62/257,338 filed on Nov. 19, 2015.

BACKGROUND OF THE INVENTION

This application concerns presses such as trim presses used in thermoforming products to cut the individual molded parts free from the plastic sheeting in which the parts have been thermoformed.

Such presses are designed to be used to trim different parts by changing tools mounted in the press.

A movable platen has a tool mounted thereto, and is typically reciprocated by a rotating pair of flywheels, the flywheels driven by a motor with interposed gearing or belt drives. The flywheels drive the movable platen by means of a pair of connecting arms, each driven by a respective flywheel. Each connecting arm has a crank pin housing at one end having a bore receiving a crank pin secured to the flywheel at an off center location. An opposite end of each connecting arm is pivotally connected to one side of the movable platen. Rotation of the flywheels causes stroking of the movable platen by the connecting arms, which causes the tool on the platen and a mating stationary tool to cut thermoformed parts free from the sheet.

The sheet with the parts formed thereon is fed into the press step by step, advanced after each cycle of the press to bring the next set of parts to be trimmed from the sheet into alignment with the tool.

In order to trim a different part the tool for a given part must be removed from the press and a different tool to be used with each different part installed in its place.

The tools are typically complex and bulky, having ejectors, take off tubes, etc., installed thereon which make it difficult to change tools.

The tool often must be partially disassembled while still in the press in order to be removed, since the movable platen cannot be retracted sufficiently to create a enough clearance to remove the tool with the attachments on the tool still installed.

This process is very time consuming and results in an extended shutdown of the trim press, as much labor is required to accomplish a tool changeover if the tool must be at least partially disassembled.

As noted above, it is also sometimes necessary to perform maintenance on the tool such as sharpening the cutting edges, and the small clearances available when the platen is fully retracted often makes maintenance on the tool while in the press difficult or impracticable.

Another difficulty is encountered in the changing of the stroke of the press, which often must be done when a different part is to be trimmed. This requires a radial relocation of the connection of each crank pin assembly on an associated flywheel either closer to its center or further away. Since two crank pins are present, each on a respective flywheel, the crank pins must be completely removed from the associated connecting arm. This is because the movable platen is mounted on linear bearings and shifting a crank pin to adjust the stroke would tend to cause movement of the movable platen by the connecting arm since it is connected to the crank pin. If only one crank pin is adjusted at a time, binding of the platen on the linear bearings would result. Thus, the crank pins must usually be completely detached and then installed at the new location so as to avoid binding of the platen.

A time consuming complete detachment of each of the crank pins from the associated connecting arm is required to change the press stroke by the conventional practice.

Such presses also often have counterweights which are driven by the press in the opposite direction from the movable platen to balance out the momentum of the platen and thereby allow higher speeds of operation by minimizing movement of the press caused by reaction forces generated by reversing movement of the movable platen and tool.

However, changing the stroke of the movable platen can result in causing the platen momentum to be unbalanced by the counterweight motion, limiting operational speeds and causing rapid wear of some of the mechanical components.

Accordingly, it is an object of the present invention to provide a press which quickly and easily allows a temporary greater extent of retraction movement of the movable platen so as to be sufficient to create a clearance adequate to accommodate the removal of a complete tool with accessories attached; and, to also allow maintenance to be carried out on the tool while it is still in place in the press.

It is a further object of the present invention to provide an arrangement for adjusting the stroke of a press in which the crank pins do not have to be detached from the connecting arms in order to shift the location of their attachment to the flywheel to change the press stroke.

It is another object of the invention is to provide a counterweight system which has a counter movement which is changed correspondingly when a change in the stroke of the press is carried out.

SUMMARY OF THE INVENTION

The above recited objects and other objects of the present invention which will be understood by those skilled in the art are achieved by incorporating connecting arms which are each made in two sections with adjacent ends which are pivotally connected to each other. However, the connecting arms are normally fixedly held in end to end alignment with a locking arrangement so as to be able to function normally when in use. If a tool is to be removed or maintained, the pivotal connection is activated by release of the locking arrangement which only requires removing or loosening a few fasteners to allow the connecting arm sections to pivot with respect to each other. The connecting arm sections of each connecting arm which are nearest the flywheels are first locked to an associated flywheel by installation of temporary pins. The flywheels are then manually rotated with a handwheel which swings both of the connecting arm sections down.

This mutual pivoting motion of the connecting arm sections draws the movable platen substantially further back from its normal fully open position to create a much greater available clearance around the tool than exists after stroking the press to the fully retracted platen position.

This allows much greater clearance for removing and replacing the tools in a completely assembled state; or, to carry out maintenance on the tool while still in place installed in the press.

Adjustment of the press stroke can also be much more quickly and easily carried out after the connecting arm sections are released to be able to be pivoted.

The attachment of the bolts connecting the crank pins to respective flywheels are removed (along with a locating dowel) to allow shifting of each of the crank pins to a radially shifted position corresponding to the desired new press stroke and the bolts (and the dowel pin) reinstalled.

This shifting adjusting of the position of the crank pins only results in relative pivoting of the connecting arm sections and is not transmitted to the movable platen, so that each crank pin can be adjusted separately to different positions on the flywheel corresponding to the desired press stroke while still being connected to the connecting arms.

The connecting arm sections are then restored to their aligned run condition, and the locking arrangement restored to be made ready for normal press operations.

A counterweight connecting arm is pinned to a counterweight drive link which is positively engaged to an end of each crank pin so as to be driven thereby by the associated flywheel which also drives the associated connecting arm and movable platen. The drive link has a series of holes along its length, each corresponding to one of the adjusted positions of the crank pin end on the flywheel so the counterweight stroking movement is changed in correspondence with the stroke change of the press platen itself. The weight of the counterweight is set approximately to that of the movable platen plus the average tool weight so as to maintain a substantial momentum balance between the platen and counterweight in each adjusted press stroke setting.

DESCRIPTION OF THE DRAWING FIGURES

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
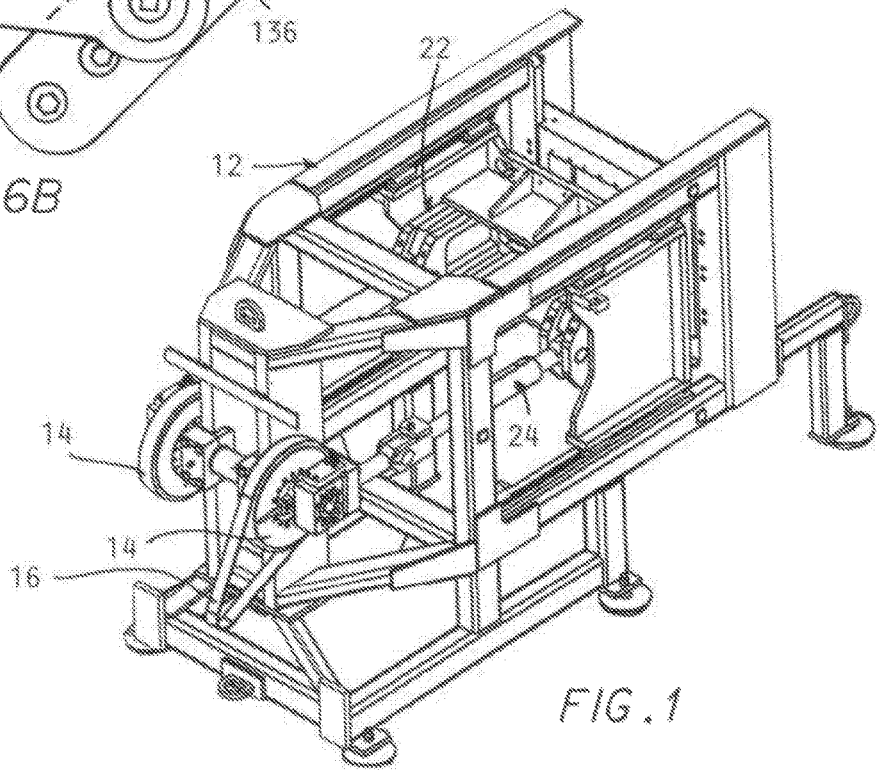
FIG. 1 is a pictorial view of a trim press according to the features of the present invention.
Figure 2:
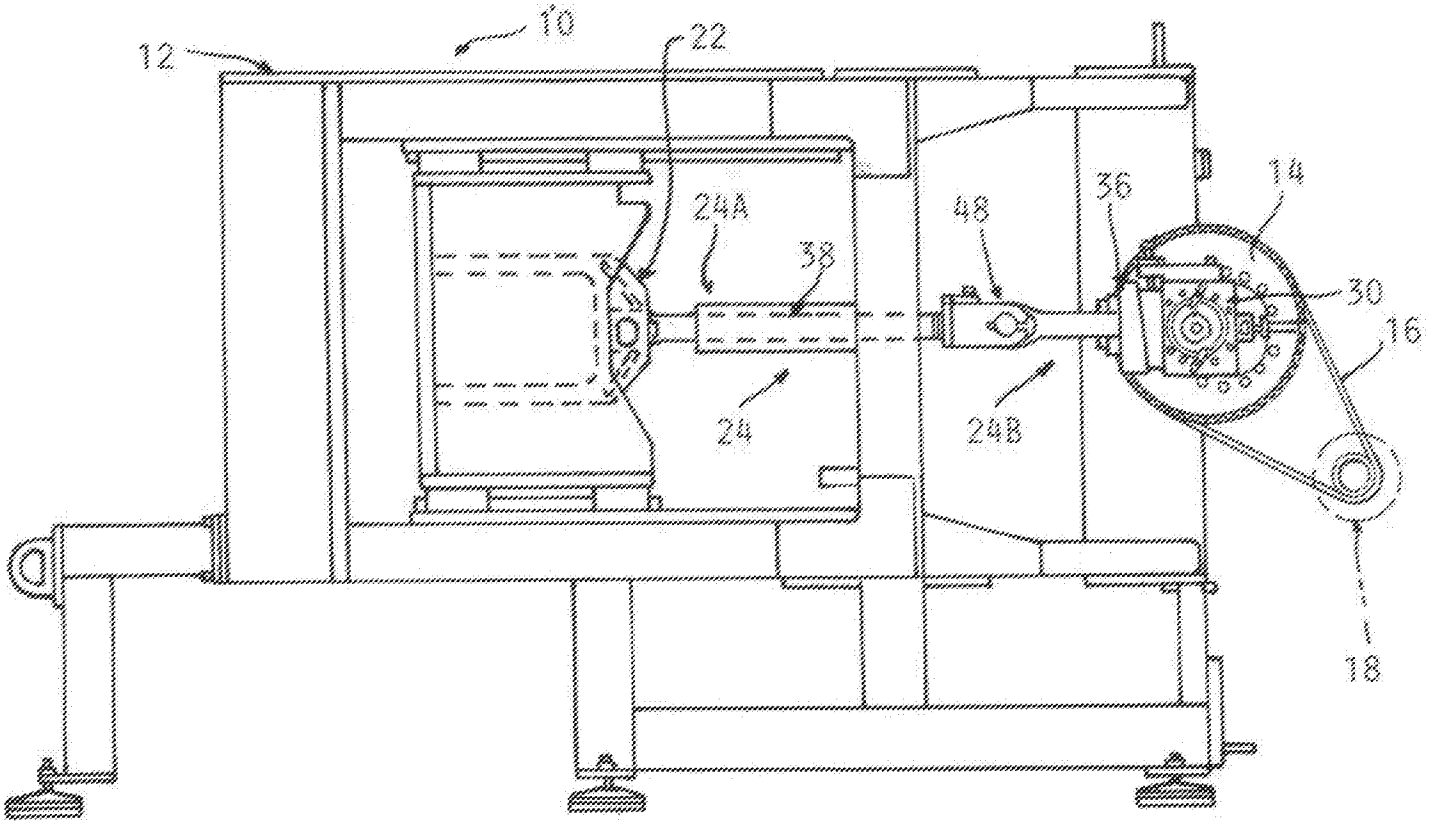
FIG. 2 is a side elevational view of the trim press shown in FIG. 1 with certain components removed for the sake of clarity.

Referring to the drawings and particularly FIGS. 1 and 2, a trim press 10 is shown, with various conventional components omitted for the sake of clarity. The invention is applicable to other presses as well. A press frame 12 supports a pair of conventional rotary flywheels 14, each driven by a respective drive belt 16 (only one shown in FIG. 1) driven by a conventional drive 18 which may be comprised of an electric motor, belt sheaves, etc. (partially shown in FIG. 6).

The flywheels 14 are connected to each other with a shaft 20 to insure synchronous rotation of the two flywheels 14.

A movable platen 22 is supported by the frame 12 on linear ways so as to be able to be reciprocated by a pair of connecting arms 24A, 24B according to the invention pivotally connected at one end by end fitting 25 driving the platen 22 by a connection including pins 26 extending through bushings and received in bores in clevises 28 in the conventional manner.

The other end of each of the connecting arms 24A, 24B is connected to a respective crank pin assembly 30 which includes a crank pin 32 fixed to an associated flywheel 14 (see FIG. 4) at a selective one of a series of locations each radially offset from the centerline of the flywheel 14 as described hereinafter.

Rotation of the flywheels 14 rotates the respective crank pins 32 in a bore housing block 34, and thereby reciprocates the associated connecting arms 24 fixed at the other end to the housing block 34 with an interposed fine adjustment connection 36.

The fine adjustment connection 36 has been previously in commercial use, but will be described in detail hereinafter in the interests of completeness.

Suffice it to say, the overall lengths of the two connecting arms 24 must be precisely set to insure that the platen 12 is properly driven, and located in its advanced position to achieve proper trimming, and this may be accomplished by a shut height adjustment assembly 38 located next to each connecting arm end fitting 40 engaged with the platen 22. The shut height adjustment assemblies 28 allow adjustment to an approximate the position of the movable platen 22 when fully advanced.

The shut height adjustment assemblies 38 shown have been in commercial use previously and include a threaded shaft portion 42 of end fittings 40. A pair of semicircular pieces 44 are assembled together to form a sleeve enclosing at one end the threaded end of the fittings 40 and 42, an end of a shaft 46 connected to the connecting arm drop connections 48 according to the invention. The semicircular pieces 44 are tightened together thereon by machine screws 50 so as to tightly clamp the sleeve 50 formed onto the threaded end fitting 42 and shaft 46.

By loosening the screws 50, the sleeves formed can be rotated to advance or retract the end fittings 40 and thus change the position assumed by the movable platen 22 at the end of the stroke of the press 10 and thus vary the shut height in a manner well known in the art.

Figure 5A:
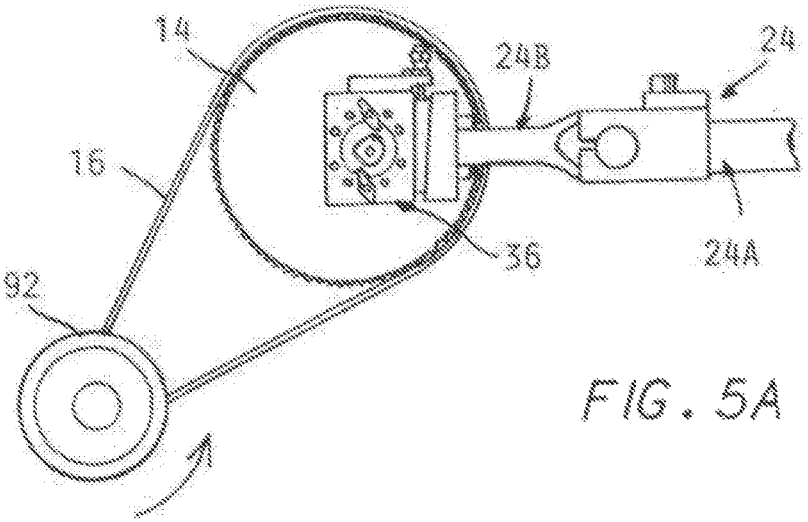
FIGS. 5A and 5B are simplified end views of a crank pin assembly and a connecting arm sections depicting manual rotation of an associated flywheel to position the connecting arm sections.

The connecting arm drop pivot connection 48 generally allows either of the two sections 24A, 24B of each of the connecting arms 24 on either side of the drop pivot connection 48 to either be held straight in alignment, so as to function in the normal fashion, or to be able to be pivoted with respect to each other allowing the connecting arm sections 24A, 24B to drop down and form a sharp angle with respect to each other (see FIGS. 5 and 5A).

Figures 3, 3A:
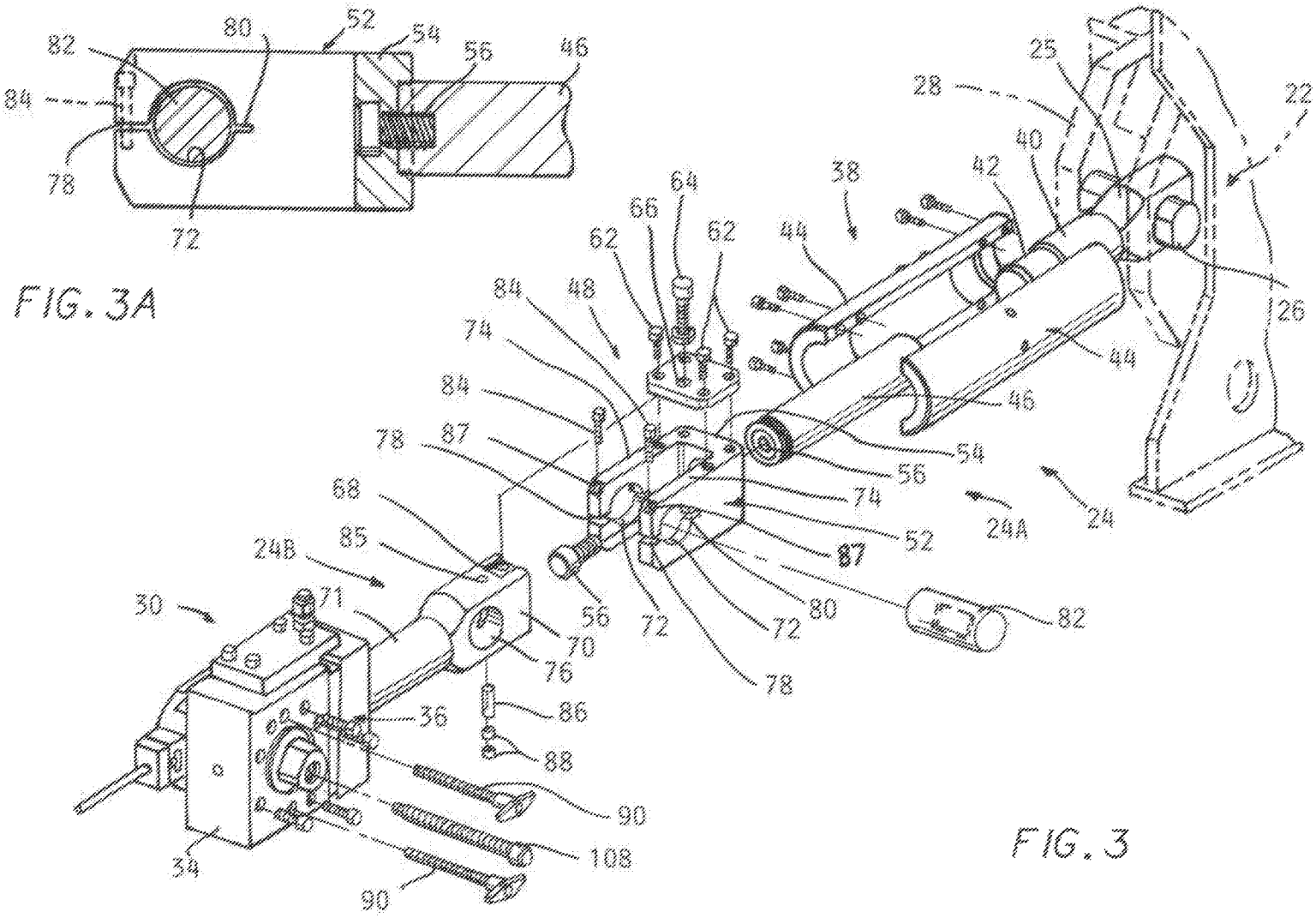
FIG. 3 is an exploded pictorial view of the components of a connecting arm according to the present invention with a fragmentary portion of a connected movable platen.
FIG. 3A is an enlarged partially sectional view of parts of the trim press shown in FIG. 3.

A generally U-shaped piece 52 is attached to the shaft segment 46 projecting from the shut height adjustment assembly 38, threaded into a shallow hole 53 in the end wall 54 and secured therein with a bolt 56 threaded in a threaded hole 58 in the shaft 46 (FIG. 3A).

A plate 60 is attached to the upper threaded side of the U-shaped piece with screws 62.

A bolt 64 is inserted through a central hole 66 in the plate and threaded into a threaded hole 68 in the top of an end fitting 70 on the other arm section.

A pair of aligned larger diameter bores 72 in the sidewalls 74 of the piece 52 are aligned with a bore 76 in end fitting 70 when the end fitting 70 is inserted between the sidewalls 74.

A pair of through slots 78 extend into the end faces of sidewalls 74 and notches 80 are machined into the opposite side of the bores 72 create sufficient compliance to releasably grip a pivot pin 82 when a pair of screws 84 are advanced and into threaded holes 87 extending across slots 78 and tightened.

Thus, when bolt 64 is installed, pivoting between the two connecting arm sections 24A, 24B is prevented.

The pivot pin 82 also has a flat formed thereon which when the pivot pin 82 is installed is aligned with a small hole 85 which receives a tapered pin 86 which creates a wedged locking of the pin 82 when threaded set screws 88 are installed. Thus, pivot pin 82 is locked in the bore 76 of end fitting 70. This insures that when the pivot pin 82 is gripped, relative rotation between the two connecting arm sections 24A, 24B is prevented.

It will be appreciated by those skilled in the art that the connection must be very precise and secure to be able to withstand trimming operations conducted at high speed for extended periods. The fixing measures including the pivot pin 70 are necessary to avoid problems when the trimming operations are underway.

The bolt 64 is removed and the screws 84 are loosened to create a drop condition of the connecting arm sections 24A, 24B. Preparatory to setting up the connecting arm drop condition, temporary locking pins 90 are installed to lock each block 34 to a respective flywheel 14.

This prevents the adjacent ends of the two connecting arm sections 24A, 24B from dropping down when allowed to pivot with respect to each other, and this also enables manual lowering movement of the arm sections 24A, 24B to a sharply angled, relative position and rotation back up into alignment after the tool replacement or maintenance task has been completed.

Figure 5B:
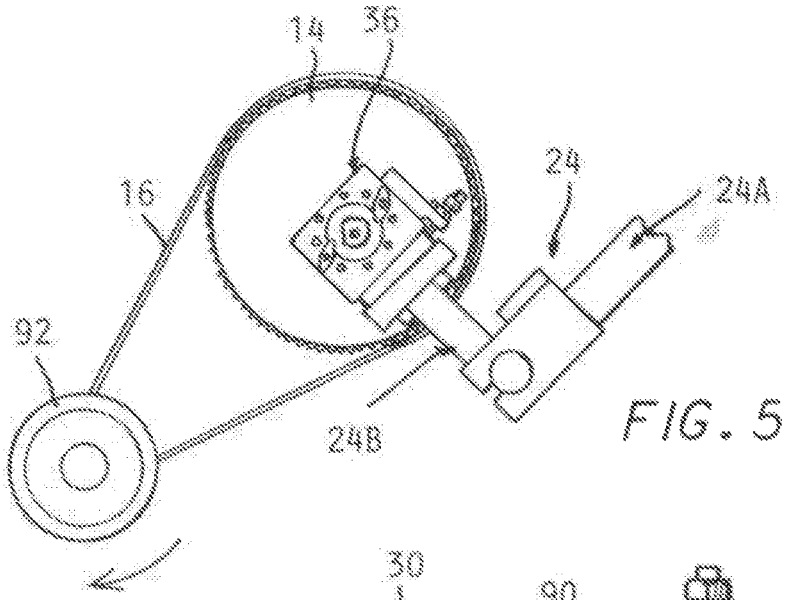
Figure 4A:
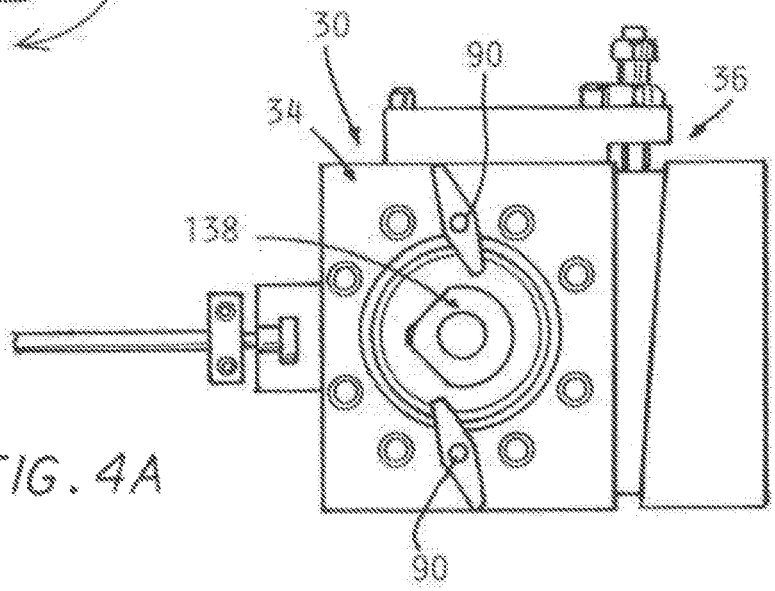
FIG. 4A is an enlarged end view of a crank pin assembly shown in FIG. 4.

A manual actuation wheel 92 (FIGS. 5A, 5B) usually provided for such press mates with a power take off (not shown) from the flywheel drive 18 and is used to manually rotate the flywheels 14 and lower the connecting arm sections 24A, 24B to the sharply angled condition of FIG. 5B.

This further retracts the movable platen 22 a substantial distance from its normal fully retracted position to allow ample clearance for removal of the assembled tool or to do maintenance on the tool when remaining in the press.

It will be understood by those skilled in the art that an overhead canopy is provided by conventional practice is not shown in the drawings which supports the sheet with parts formed therein, and a guide assembly for the sheet guiding (also not shown) are both moved out of the way when this operation is conducted which is also done when changing tools in the conventional manner according to the prior practices.

Figure 4:
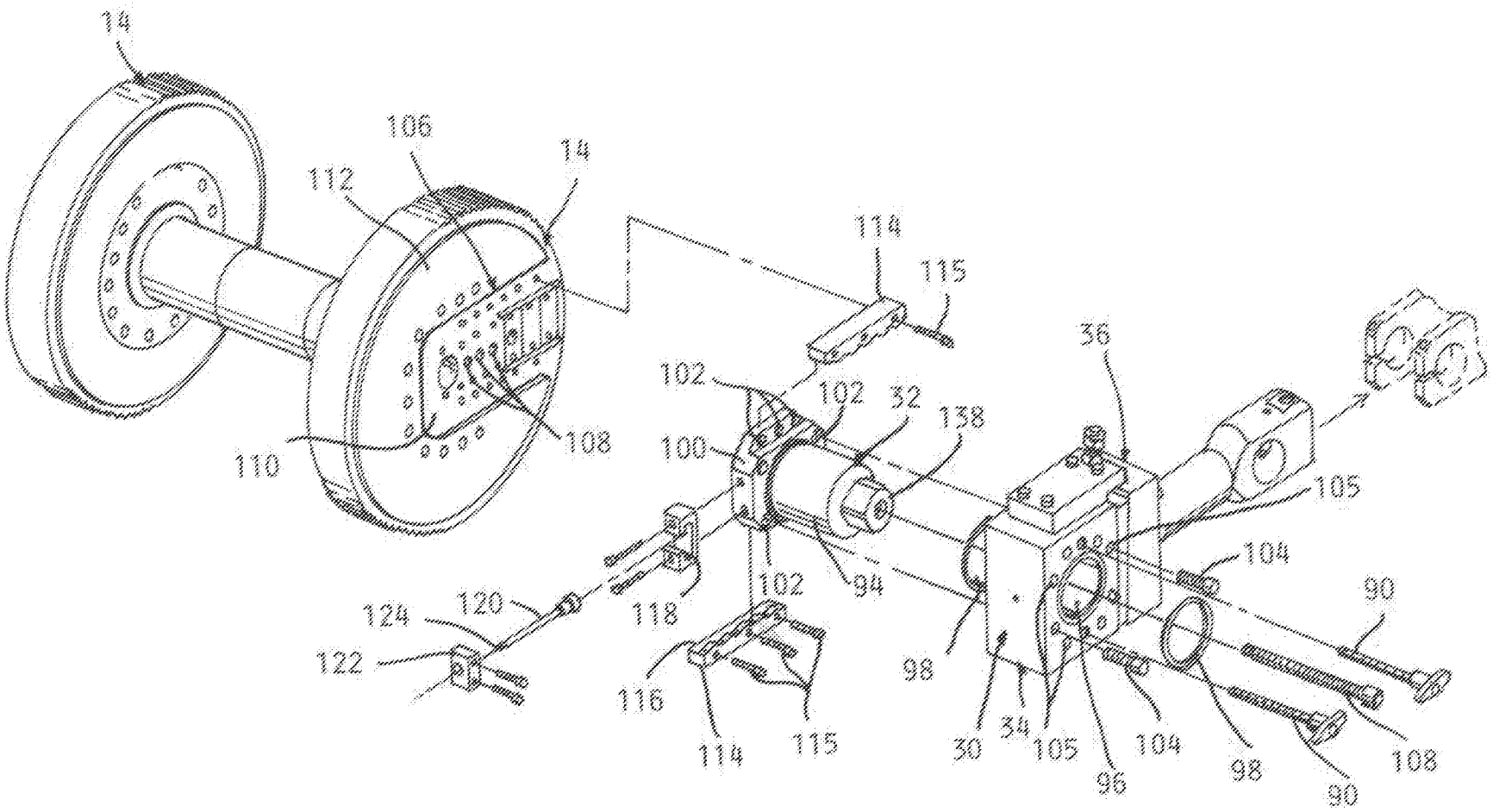
FIG. 4 is an exploded pictorial view of the components driving the connecting arm by an associated flywheel.

Referring to FIG. 4, details are shown of the adjustable connection between each crank pin 32 and an associated flywheel 14 and its relationship with the block crank pin housing 34.

A flanged portion 100 of the crank pin 32 is provided, formed with a pairs of bolt holes 102 located on each side for receiving bolts 104 (only two shown) which are used to attach the crank pin 32 to the face of a flywheel 14 at four different radially offset locations, each corresponding to a one of the four stroke lengths available in the press shown.

The holes 102 in the housing block 34 are large enough to allow a socket wrench to pass through to tighten the bolts 104 and secure the crank pin 32 to the radial face of the flywheel 14 at any adjusted position.

A series of locator holes 108 are also provided for receiving a threaded locator dowel pin 108 for precision location of the crank pin 32 with respect to the flywheel 14.

The end face of the flange 100 of the crank pin 32 slides across the face 112 of the flywheel 14 when making a stroke adjustment, hence a recess 110 is machined into the flywheel radial face 112 to provide a smooth surface, and also to precisely locate the position of the crank pin 32 in the proper location with respect to the platen 22 and the mounting surface of the other end of the connecting arm 24 as will be understood by those skilled in the art.

A pair of guides 114 are secured to the flywheel face with screws 115 at respective locations above and below the crank pin 32 so as to hold the crank pin 32 in position after the bolts 104 are removed while allowing sliding stroke adjustment movement. Cutouts 116 provide clearance for the heads of bolts 104 when installed.

A mechanical adjustment operator bolt 20 for moving the crank pins 32 is created by a U-shaped piece 118 attached to one side of the crank pin 32, capturing the head of the operator bolt 120 which is threaded along its entire length to be able to be threaded into an anchor element 122 fixed to the flywheel face 110. A small hex end 124 allows a ratchet wrench to be used for carrying out the stroke change adjustments by shifting the crank pin 32 radially across the flywheel recess 110.

The steps involved in creating a drop away action of the connecting arms 24 comprise:

1. First, the moving platen 22 is manually retracted to its full open position by use of the manual actuator wheel 92 described above.

2. The locking pins 90 are installed to connect each of the housing blocks 34 to a respective flywheel 14. This locks sections 24A, 24B of each connecting arm 24 to a respective one of the flywheels 14 to cause them to rotate together and also prevents the connecting arm sections 24A, 24B from free falling when releasing the locking arrangement allowing a pivotal connection between the sections 24A, 24B. For safety, the pins 90 are tied to an e-stop circuit and must be removed before the master control (not shown) is enabled in the well known manner.

3. The main press drive safety pin (not shown) is installed to insure that no powered platen or flywheel movement occurs during maintenance.

4. The main connection bolt 64 is removed and two clamping screws 84 are loosened on each connecting arm 24 (for each flywheel) to release the pivot connection.

5. The flywheel hand wheel 92 is engaged with a power take off of the press drive and rotated so as to move the two sections 24A, 24B of each of the connecting arms 24 to an angled position relative each other (FIG. 5B), further retracting the moving platen 22 a substantial distance from the normal retracted position, allowing better access to the trim tooling installed on the moving platen.

6. To reconnect, the steps are reversed with the connecting arm sections 24A, 24B manually positioned to again be aligned by rotation of the handwheel 92 (FIG. 5A).

7. The two clamping screws 84 are retightened and the main connection bolt 64 reinstalled.

Replacing a tool involves conventional steps including moving the trim tool elevator (now shown) forward and then lowering the same to be level with a pair of roller supports (not shown) on either side of the press. The existing tool after having been detached from the platen 22 and the lube lines thereto (not shown) disconnected, is then rolled out of the press and onto one of the roller supports on the other side of the press. The new tool is then rolled in from the other roller support. The trim tool elevator is then raised to align the new tool with the platen 22 and reattached.

The drop away arm sections 24A, 24B are pivoted to be aligned by normal operation of the press drive as described above, and the locking arrangement 48 reinstalled.

The locking pins 90 are removed and stored in a fixture and associated safety keys (not shown) inserted.

The flywheels 14 are manually moved to the advanced position.

The treadle and guides are lowered and canopy moved forward (neither shown).

The shoe bolts (not shown) replaced.

These carrying out of these steps can be viewed on a video at https://www.youtube.com/watch?v=9rjvpbr-ido, which is hereby incorporated by reference.

The steps for a simpler, faster stroke adjustment comprise:

1. The moving platen 22 is retracted to its full open position by use of the manual actuation wheel 92.

2. The pins 90 are installed into the body of each of the connecting arm sections 24B. These pins 90 lock the body of each of the sections 24B connecting arms 24 to a respective flywheel 14 and also prevent both of the connecting arms sections 24A, 24B from free falling when releasing the pivot connection. For safety, the pins 90 are tied to the e-stop circuit (not shown), and must be removed before the master control (not shown) is enabled.

3. The main drive safety pin (not shown) is installed to insure no powered platen or flywheel movement occurs during maintenance.

4. The bolt 64 is removed and two clamping screws 84 are loosened on each connecting arm 24.

5. The flywheel hand wheel 92 is installed and rotated to locate the crank pin 32 in the stroke change position shown in FIG. 4.

6. The counterbalance drive arms are disconnected (if the counter balance arrangement described below is included).

7. The bolts 104 retaining the crank pins 32 to the respective flywheels 14 are removed.

8. The dowel pins 108 that locate the crank pins 32 to the flywheels 14 are removed.

9. The desired stroke adjustment is carried out by a ratchet wrench rotating stroke setting bolt 120.

10. The crank dowel pins 108 are reinstalled.

11. The crank pin to flywheel retaining bolts 104 are reinstalled and tightened.

12. The flywheel hand wheel 92 is rotated until the sections 24A, 24B of the connecting arms 24 are in their straight aligned position.

13. The bolts 64 are installed and screws 84 tightened.

14. The counter balance drive arms are connected to the end of the respective crank pins 32 (described below) if the counterbalance is included.

15. The locking pins 90 are removed and reinstalled into an e-box.

16. The platen shut height is adjusted if needed.

The system may optionally incorporate an arrangement for driving a counterbalance weight which is improved over the prior practice.

The arrangement achieves improved balancing between the trim tooling and platen momentum and the counterbalance weight momentum. This is accomplished by making the stroke of the counterbalance weight motion adjustable to always be equal to the stroke of the moving platen, establishing approximately equal inertia between the platen and tool weight and the counter balance weight. The counterbalance weight is selected to be equal to the combined weight of the moving platen and average moving tool weight. This will improve the performance of the trim press by allowing the press to run at increased speeds with considerably less trim press movement. It will also reduce the wear on some of the mechanical components due to the improved stability of the press.

Figure 6A:
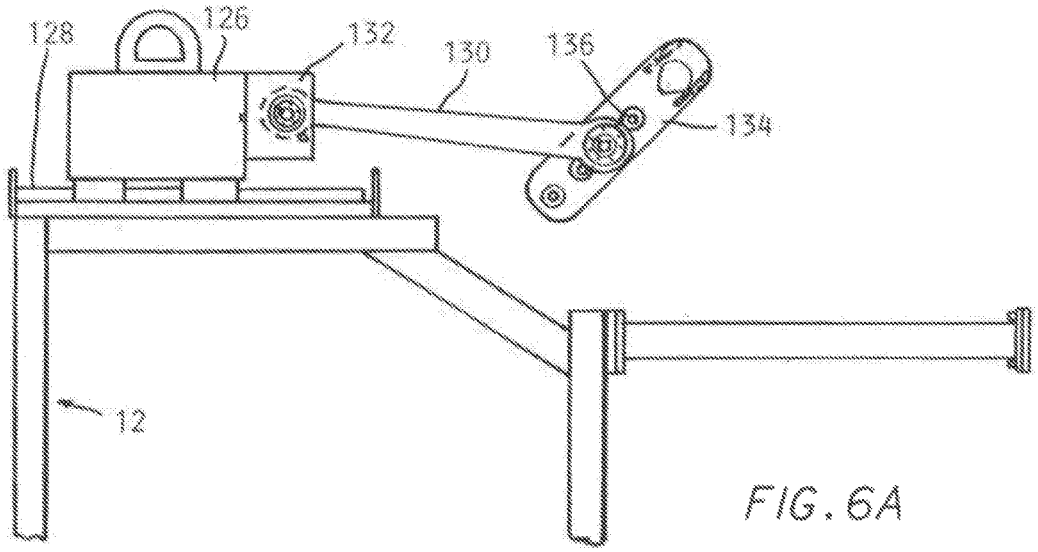
FIG. 6A is a side view of the counterweight mechanism.
Figure 6B:
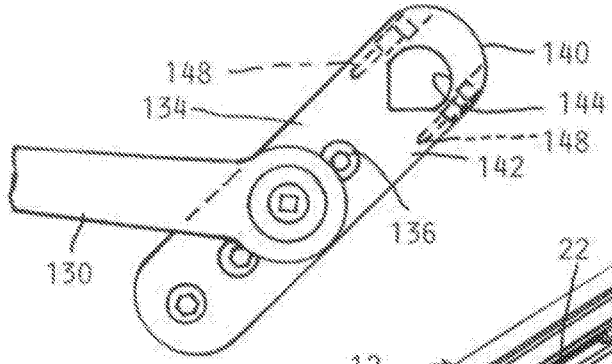
FIG. 6B is an enlarged side view of a drive link and a portion of a counterweight connecting arm included in the counterweight mechanism shown FIG. 6.
Figure 6:
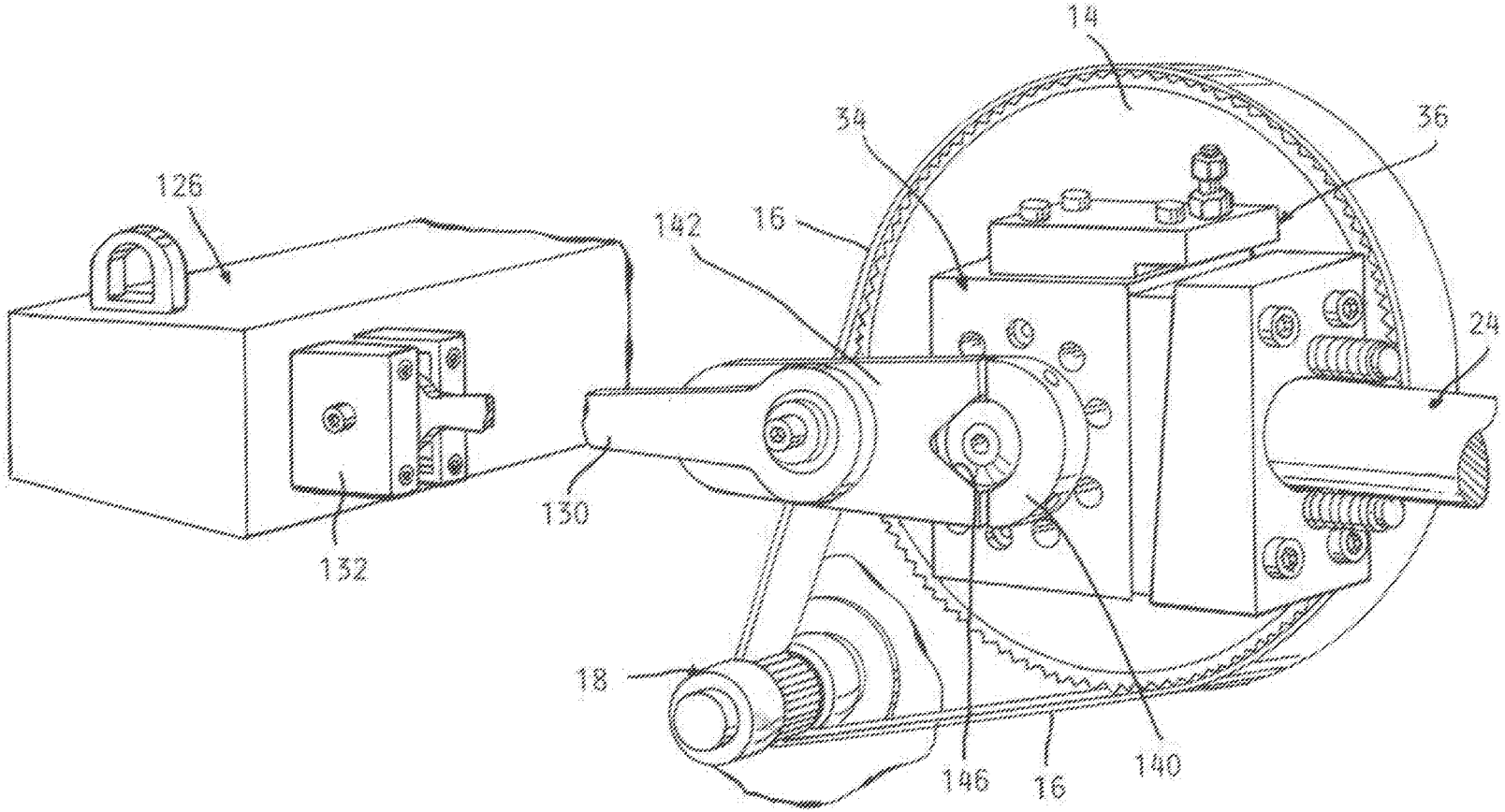
FIG. 6 is a pictorial view of a counterweight mechanism associated with a crank pin assembly and flywheel.

Referring to FIGS. 6A and 6B, the counterbalance weight 26 is slidably mounted on the press frame 12 on horizontally extending rails 128.

A counterbalance connecting arm 130 is provided for each flywheel 14 pivotally connected at one end to the counterweight 126 by a bracket 132.

The other end of the counterweight connecting arm 130 is connected to a counterweight drive link 134 which has a linear series of holes 136 formed therein along its length, the other end of the connecting arm 130 attachable to one of those holes 136 matched to the stroke adjustment set so that both the movable platen 22 and counterweight 26 have identical but opposite synchronized strokes. The drive link 134 is non-rotatably attached at one end to the non-round end 138 of the crank pin 32 projecting out of the housing block 34 by being clamped thereto.

That is, an end piece 140 has a cut out 144 matching the circular half portion of the non-round end 138, with the link body 142 having an aligned angled cut outs 146 having sides engaging the flat portions of the crank pin end 138, and screws 148 secure the end piece 140 against the end of the link 134 to create a positive drive connection between the crank pin 32 and the link.

If the counterbalance weight is not included a clamping cap is installed to retain the crank pin 32 in the housing block 34.

The fine adjust mechanism 36 heretofore has been previously in use and does not itself comprise the present invention.

The final advanced position of the movable platen 22 (the shut height) must be set in order to properly carry out the trim operation by movement of the tool mounted to the movable platen 26. The shut height mechanism 36 which has heretofore been known may be used to do this.

The accuracy of that shut height adjustment may not be sufficient, and the fine adjustment mechanism 36 may enable a final setting of the shut height.

Figure 7A:
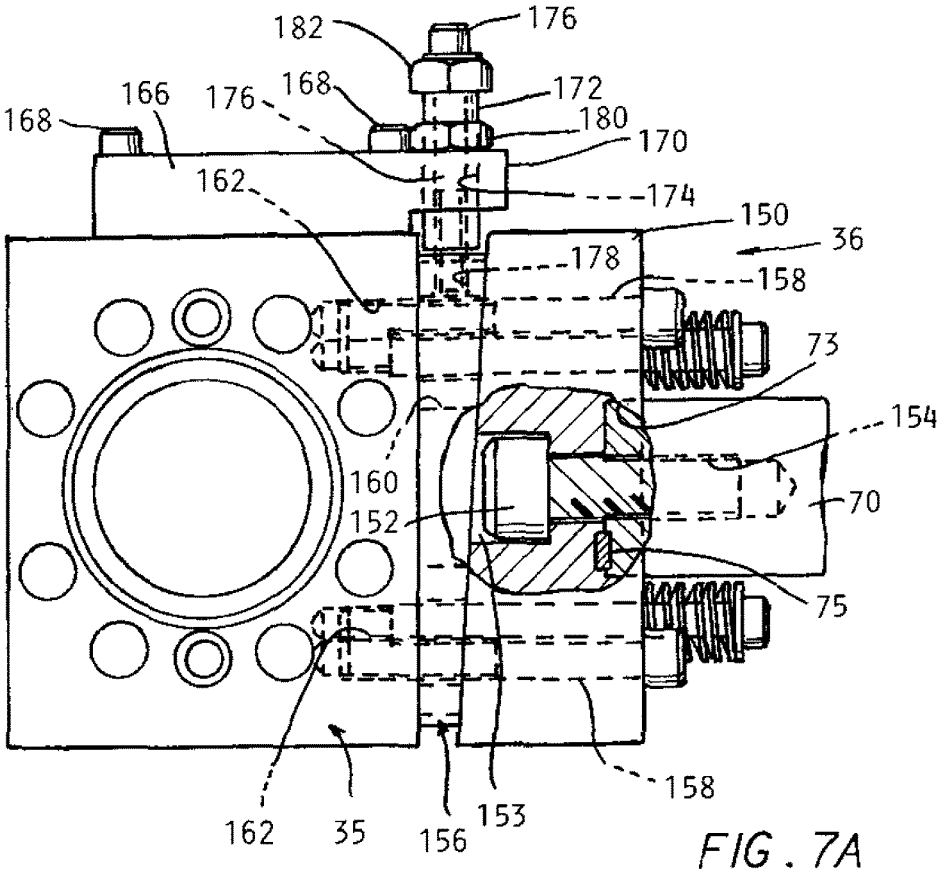
FIG. 7A is an enlarged side view of the fine shut height adjust arrangement shown FIG. 7, in partial section.
Figure 7:
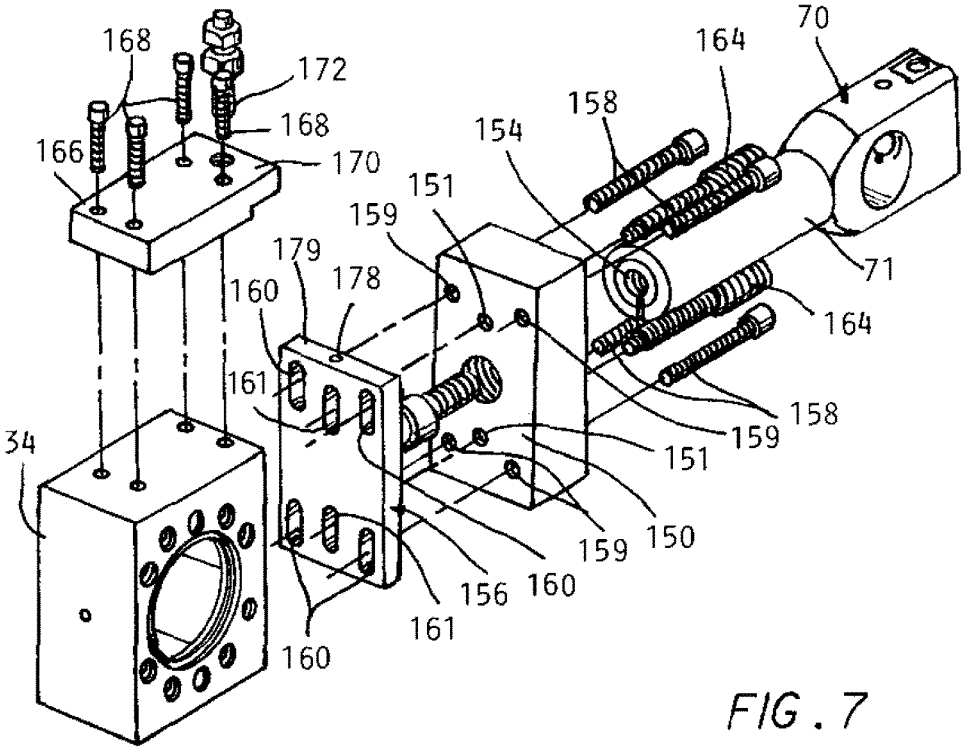
FIG. 7 is an exploded pictorial view of a fine shut height adjust arrangement incorporated in a connecting arm according to the invention.

Referring to FIGS. 7 and 7A the fine adjust shut height mechanism 36 includes an end block 150 connected to the connecting arm section 24B by a bolt 152 inserted into a counter bore 153 therein and threaded into a threaded hole 154. The round end 71 of the fitting is itself received in a bore 73 and engaged by a key 75 to prevent rotation therein.

A wedge plate 156 is interposed between end block 150 and the right side of connector block 34 described above as viewed in FIG. 7A. Four screws 158 pass through holes 159 in the end block 150 and elongated slots 160 in the wedge plate 156 and threaded into aligned threaded holes 162 in the abutting side of the connector block 34 (FIG. 7) to secure these components stacked together when the screws 158 are tightened down.

Two spring loaded screws 164 are also installed in offset respective holes 151 and slots 161 but are only loosened into not removed when making adjustments, which are provided to hold the stacked components in contact together when making these adjustments.

A top plate 166 is attached to block 34 with four screws 168, with a stepped end 170 projecting over the top of the wedge plate 156 with a clearance therebetween.

A threaded sleeve 172 is threaded into a threaded bore 174 in the stepped end 170 and projects onto the top of the wedge plate 156. An inner screw 176 extends within the sleeve 172 and is received in a threaded hole 178 in the top 179 of the wedge plate 156.

The vertical movement up or down of the wedge plate 156 turned with hex feature 182 causes a slight lengthening or shortening of the overall length of the connecting arm 24. Tightening of the screws 158, 164, and a lock nut 180 secures the length adjustment set.

The invention claimed is:

1. A press having a movable platen adapted to mount a tool for carrying out an operation by said press, said movable platen connected to one end of an elongated connecting arm, an opposite end of said connecting arm driven by a press drive to reciprocate said platen and said tool mounted thereon between fully retracted and fully advanced positions, said connecting arm divided into two sections which are held aligned with each other in a lengthwise direction during said reciprocating movement of said platen by a selectively activated locking arrangement, each connecting arm section having an end adjacent to an end of the other of said two sections of said connecting arm, said adjacent ends of said connecting arm joined together by an interposed pivot connection, with said locking arrangement normally acting on said pivot connection to prevent relative pivoting motion of said connecting arm sections during reciprocating movement of said platen by said press drive and to hold said connecting arm sections in lengthwise alignment, said locking arrangement selectively able to be released to allow said pivoting of said connecting arm sections relative each other when said press is not operated by said press drive and to thereby be able to retract said platen further past said fully retracted position, so as to create a greater clearance between said tool and said press to facilitate removal of said tool and replacement with another tool or to perform maintenance on said tool while still remaining installed on said movable platen in said press.

2. The press according to claim 1 wherein said pivot connection between said connecting arms includes a generally U-shaped piece attached to one of said adjacent connecting arm section ends and holding a pivot pin extending through aligned holes in two legs of said U-shaped piece, a fitting attached to an other of said connecting arm adjacent section ends and having a portion disposed extending between said two legs of said U-shaped piece with said pivot pin passing through a hole in said portion aligned with said holes in said two legs so as to allow pivoting between said connecting arm sections about said pivot pin.

3. The press according to claim 2 further including an arrangement on one of said section ends for gripping said pivot pin and fixing said pivot pin to the other of said section ends whereby resisting pivoting of said two section relative each other.

4. The press according to claim 3 further including a bolted affixation of said portion of said other of said connecting arm adjacent section ends to a plate affixed to said U-shaped piece extending between said two legs to prevent rotation therebetween and thereby hold said connecting arm sections in alignment.

5. The press according to claim 4 wherein said pivot pin is received in aligned holes extending through said two legs, and wherein said gripping arrangement includes slots formed in said two legs extending into each of said holes therein to allow selective releasable compression of a perimeter of each hole onto said pivot pin to resist pivoting of said connecting arm section ends.

6. The press according to claim 5 wherein threaded fasteners extend into each of said two legs and extending across said slots from one side thereof and threaded into holes on an other side of said slots thereof so as to enable squeezing sides of said slots together by tightening said threaded fasteners to establish said releasable grip on said pivot pin.

7. The press according to claim 1 further including a crank pin having one end rotatably mounted in an opening in a crank pin housing attached to an outer end of an outer one of said sections of said connecting arm remote from said movable platen, said crank pin affixed to a radial face of a rotary flywheel included in said press drive projecting out from an off-center location thereon by means of threaded fasteners to create said reciprocation of said movable platen upon rotation of said flywheel, said crank pin able to be attached at a plurality of aligned radially offset positions on said flywheel face by means of a threaded hole pattern in said flywheel face allowing said threaded fasteners to be received in sets of alternate threaded holes corresponding to each offset position, thereby allowing different press strokes to be set; and, further including one or more locking elements installed temporarily when making an adjustment in said position of said crank pin thereby enabling locking said crank pin to said crank pin housing to cause said outer connecting arm section to rotate with said crank pin and flywheel, said flywheel able to be manually rotated by a handwheel selectively engageable with a flywheel drive to lower and pivot together said connecting arm sections after release of said locking arrangement.

8. The press according to claim 7 further including crank pin guides holding said crank pin on said radial face of said flywheel after removal of said threaded fasteners and guiding said crank pin movement in being moved along said radially offset positions thereon.

9. The press according to claim 8 further including a threaded actuator element having a head captured by a feature on said crank pin and extending laterally to a threaded seat fixed to said flywheel through which said actuator member is threaded, with a wrenching feature on an end opposite said head to enable rotation of said actuator element to shift said crank pin on said flywheel radial face.

10. The press according to claim 7 further including a counterweight slidable along support rails, said rails extending in an opposite direction from said crank pin arm away from said movable platen;

a counterweight connecting arm pivotally connected to said counter weight at one end and extending back towards said crank pin housing;

a counterweight drive link having one end fit to an end of said crank pin protruding from said crank pin housing in a direction away from said flywheel so as to establish a rotary connection therebetween to be rotated by said crank pin; and, said counterweight connecting arm pivotally connected to said counterweight drive link at an opposite end by a pin connection to one of a series of holes therein at a spacing corresponding to the stroke lengths defined by said radially offset positions of said crank pin on said flywheel whereby a stroke of said counterweight is substantially equal to said stroke of said movable platen but in an opposite direction.

* * * * *